US007229334B2

(12) United States Patent
Ishikawa

(10) Patent No.: US 7,229,334 B2
(45) Date of Patent: Jun. 12, 2007

(54) TOY HOUSE ASSEMBLY

(76) Inventor: Akiko Ishikawa, 3-22-3 Inogashira, Mitaka-shi, Tokyo, 181-0001 (JP)

( * ) Notice: Subject to any disclaimer, the term of this patent is extended or adjusted under 35 U.S.C. 154(b) by 0 days.

(21) Appl. No.: 10/517,191

(22) PCT Filed: Apr. 16, 2003

(86) PCT No.: PCT/JP03/04828

§ 371 (c)(1),
(2), (4) Date: Jun. 30, 2005

(87) PCT Pub. No.: WO03/003793

PCT Pub. Date: Dec. 18, 2003

(65) Prior Publication Data

US 2006/0166590 A1 Jul. 27, 2006

(30) Foreign Application Priority Data

Jun. 10, 2002 (JP) ..... PCT/JP02/05752

(51) Int. Cl.
*A63H 3/52* (2006.01)
*A63H 33/08* (2006.01)

(52) U.S. Cl. ..... 446/91; 446/110; 446/116; 446/118; 446/120; 446/477

(58) Field of Classification Search ..... 446/91, 446/108, 110, 116, 118, 120, 121, 477; 52/220.2, 52/220.8, 503, 606
See application file for complete search history.

(56) References Cited

U.S. PATENT DOCUMENTS 1,889,468 A * 11/1932 Flannery ..... 446/477
3,526,054 A * 9/1970 Raman ..... 446/91
4,462,066 A * 7/1984 Gibson et al. ..... 362/251
5,222,902 A * 6/1993 Piersch ..... 446/121
5,445,552 A * 8/1995 Hine ..... 446/477
5,848,503 A * 12/1998 Toft et al. ..... 52/173.1
5,876,261 A * 3/1999 Bach et al. ..... 446/105
6,062,937 A * 5/2000 Kikuchi ..... 446/91
6,129,605 A * 10/2000 Cyrus et al. ..... 446/118
6,679,751 B1 * 1/2004 Maxwell et al. ..... 446/91

FOREIGN PATENT DOCUMENTS

JP 43-14143 6/1968
JP 49-8345 A 1/1974
JP 49-94797 8/1974
JP 62-189798 12/1987
JP 11-107413 4/1999

* cited by examiner

*Primary Examiner*—John A. Ricci
(74) *Attorney, Agent, or Firm*—Rabin & Berdo, PC

(57) ABSTRACT

A house-building toy comprises element blocks that include floor foundation blocks (2) functioning as the foundation of a house model and structuring a floor portion of the house model, wall blocks (3) structuring a wall portion of the house model, roof blocks (4) structuring a roof portion of the house model, and floor panel blocks (5) structuring on the floor foundation blocks (2) the ground and a floor surface in the house. Hole portions communicating with the element blocks are formed at joints between the floor foundation blocks (2) and the wall blocks (3) and at joints between the floor foundation blocks (2) and the roof blocks (4). Wires (W) for supplying electricity, for example, for lighting are laid from the outside to the inside of the house model.

5 Claims, 13 Drawing Sheets

TOY HOUSE ASSEMBLY

FIELD OF THE INVENTION

This invention relates to a toy house assembly for building a toy house model using plural blocks having different shapes.

DESCRIPTION OF RELATED ART

Toy house assemblies made of plural blocks having different shapes for building toy house models used generally together with dolls and miniature furniture, more specifically, blocks structuring respective portions of real houses, such as roof, wall, and floor, have been known. With such a toy house assembly, a scaled-down model of a house is manufactured by jointing mutually plural blocks having different shapes described above in application of technology of blocks, building blocks, etc. The toy house assembly is widely used for an architectural model made when an actual building is built, a miniature model to be displayed in an exhibition, or the like, in addition to play tools for kids described above.

As a toy house assembly, a modular building built together with a land shape module made of plural land shape pieces has been disclosed in, e.g., International Patent Publication No. WO99/16037 (hereinafter referred to as Reference No. 1). This modular building has main elements of foundations, wall members, couplers, and roof units. The plural foundations jointed with the couplers make the floor of the modular building, and the wall members make the wall of the modular building mounted on the foundations with the couplers similarly. The roof units serving as the roof of the modular building are attached to the wall members In Unexamined Utility Model Publication, No. Showa 62-189,798 (hereinafter referred to as Reference No. 2), a toy house for dolls in which ornamental equipments such as wall materials and floor materials are attachable to the wall and the floor, has been disclosed.

In Unexamined Utility Model Publication, No. Showa 63-122,378 (hereinafter referred to as Reference No. 3), free-designed miniature house members scaled down at a proper ratio from an actual house have been disclosed. These free-designed miniature house members are many structural members miniaturized and modeled to have a uniform size upon classified in detail out of structural portions of houses, or namely, e.g., members for frame, floor tatami mat materials, and roof materials, and those structural members in a large number build the miniature houses.

In Unexamined Utility Model Publication, No. Showa 61-68,280 (hereinafter referred to as Reference No. 4), combinations of roof blocks for toy house model have been disclosed. With the combinations of the roof blocks, edge projecting roofs are formed in use of edge projecting blocks for jointing flat roof blocks at jointing portions between roofs extending along edge projecting lines.

The toy house assemblies as set forth in References No. 1, No. 3, and No. 4, among the conventional toy house assemblies as set forth in respective references described above, have a large number of parts. Particularly, the toy house assembly as set forth in Reference No. 1 has many members for building the foundations, and the toy house assembly as set forth in Reference No. 4 has a large number of parts for forming the edge projecting portions of the roofs, so that the assembling work becomes complicated and not easy.

The toy house assemblies as set forth in References No. 2 have a small number of parts, so that the assembling work can be done easily, but the toy house assemblies lack flexibility and extensibility in the assembling work because mounting positions are predetermined for the ornamental equipments such as the wall materials and the floor materials.

SUMMARY OF THE INVENTION

This invention is accomplished in seeking solutions in the above situation, and it is an object of the invention to provide a toy house assembly making assembling work easier in reducing the number of blocks serving as structural parts and enabling to create a real toy house model enriched with flexibility and extensibility in assembling work.

The toy house assembly according to the invention for building a toy house model by assembling a plurality of blocks different in shape, includes: a floor foundation block serving as a foundation of the toy house model to constitute a floor portion of the toy house model, having a first projection formed on a major surface of the floor foundation block to be combined with another block of a different type from the floor foundation block, and having a second projection and a recess formed on a side surface provided as perpendicular to the major surface to be combined with another block in the same type as the floor foundation block; a wall block constituting a wall portion of the toy house model and having a recess fitting to the first projection of the floor foundation block; and a roof block constituting a roof portion of the toy house model, the roof block being made of a plurality of structural block groups combined vertically and horizontally; wherein a hole for connecting the blocks combined by connection between the projection and the recess is formed at each jointing portion between the respective blocks, and wherein a wiring is provided through the hole from an exterior of the toy house model to an interior of the toy house model.

With the toy house assembly according to the invention, the roof block includes the structural block made in a substantially rectangular shape having a pair of side surfaces inclined in the same direction with the same angle to each other, and wherein the structural block forms a plane upon jointing another structural block where the side surfaces formed in parallel are jointed and forms a bending portion upon jointing another structural block where the side surfaces formed not in parallel are jointed.

According to the toy house assembly of the invention described above, wiring of wires for power supply can be done easily and flexibly utilizing the holes formed at the jointing portions of the respective blocks, and a real house model can be manufactured by providing illuminations inside the house model.

With the invention, the plane and the bending portion can be formed alternatively by changing the orientation of jointing between the structural blocks of one kind, so that any special part will not be required at a portion, at which the angle of the roofs is changed, like the main building portion, and so that the number of parts can be reduced. Accordingly, with the invention, assembling work can be done easily with thus fewer number of the parts.

THE BEST MODE FOR IMPLEMENTING THE INVENTION

Figure 1:
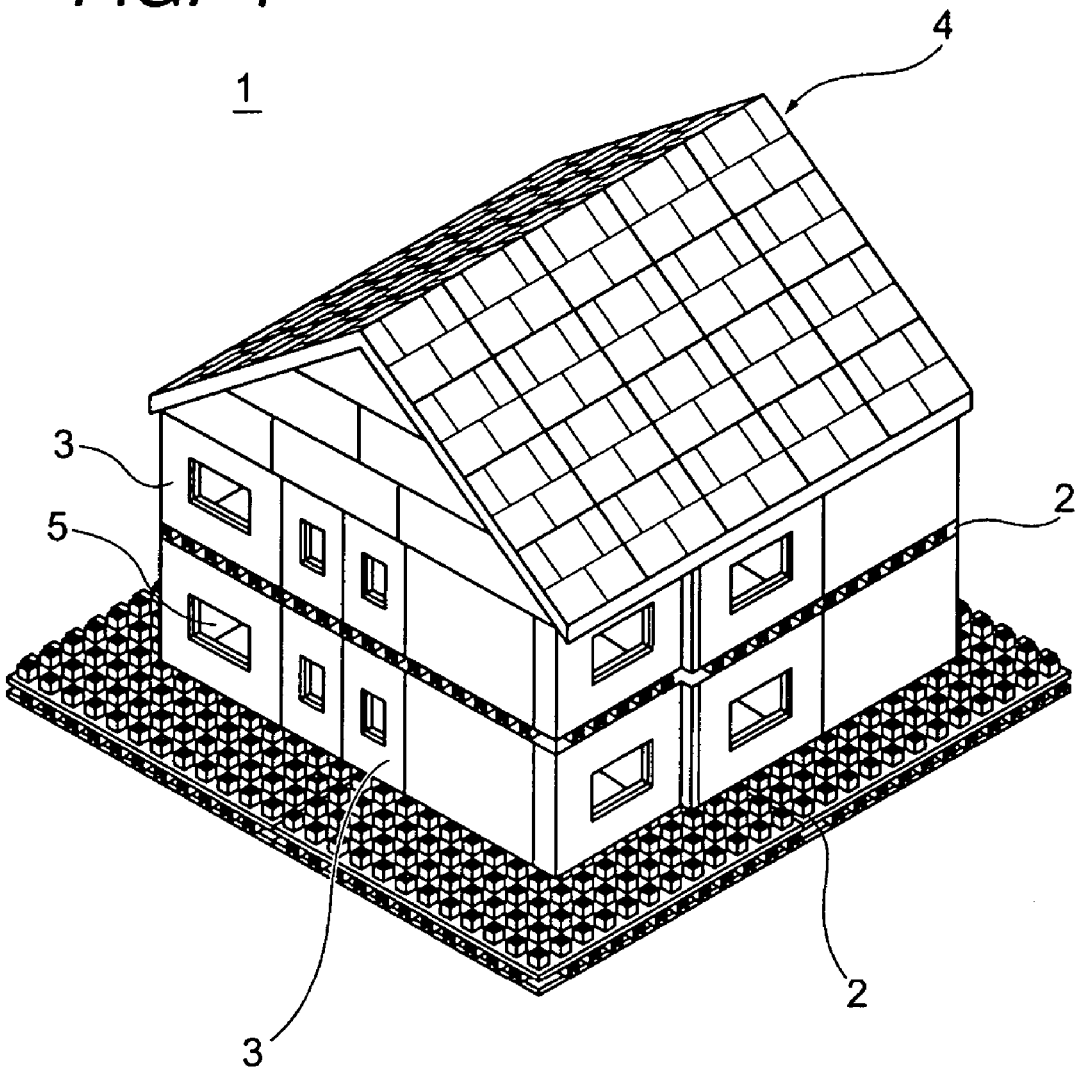
FIG. 1 is a perspective view showing a toy house assembly according to the invention.

Hereinafter, with reference to the drawings, specified embodiments according to the invention are described in detail.

A toy house assembly 1 shown in FIG. 1 as one of the best embodiments to which this invention applies is a house model of a downscaled size of an actual house, e.g., one-thirty-fifth scale, assembled by combining and jointing plural blocks made similarly of main structural elements of an actual house (hereinafter referred to as "element blocks"). The element blocks constituting the toy house assembly 1 are classified chiefly into a floor foundation block 2 serving as a foundation of the house model and forming a floor portion, a wall block 3 constituting a wall portion of the house model, a roof block 4 constituting a roof portion of the house model, and a floor panel block 5 constituting a land surface or floor surface inside the house on the floor foundation block 2.

Figure 3:
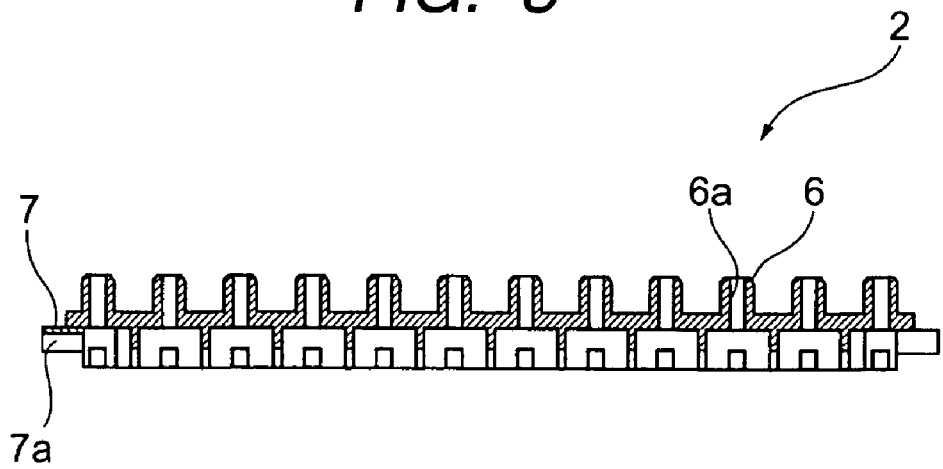
FIG. 3 is a vertical cross section taken along A—A line in FIG. 2.
Figure 2:
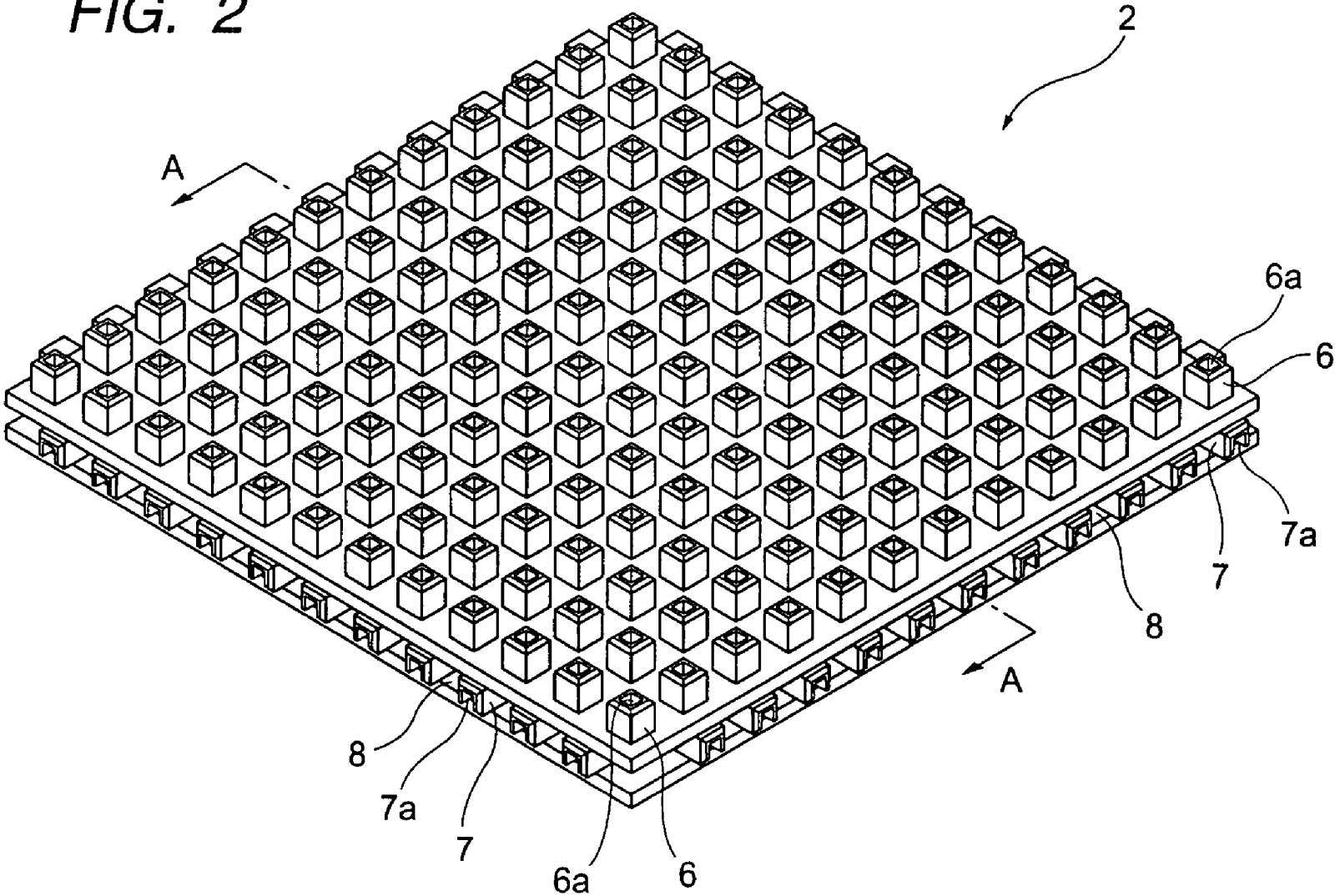
FIG. 2 is a perspective showing a floor foundation block.

The floor foundation block 2 is formed in a substantially flat plate shape as shown in FIG. 2, and plural first jointing projections 6 are formed on one major surface and arranged in a matrix form with the uniform intervals. The first jointing projection 6 is to joint the floor foundation block 2 with other element blocks as described below in detail, and, as shown in FIG. 2 and FIG. 3, is formed cross-sectionally in a square shape with a square window as a through hole penetrating the block from the one major surface to the opposite major surface.

The floor foundation block 2 is formed with plural second jointing projections 7 arranged with uniform intervals on side surfaces of the block. The second jointing projection 7 joints the floor foundation blocks 2 mutually, and has a rectangular letter U-shaped groove 7*a* opening on the opposite major surface of the floor foundation block 2. The second jointing projection 7 has substantially the same interval between the adjacent second jointing projections 7 as the width of the second jointing projection 7. Plural jointing recesses 8 formed as shown in FIGS. 2. 2, 4 along the second jointing projections 7 with respective holes 8*a* opening at the rearmost position on the opposite major surface of the floor foundation block 2 as described below, are formed on the side surfaces of the floor foundation block 2 between the second jointing projections 7. Those second jointing projections 7 and the jointing recesses 8 are formed to take positions such that the side surfaces facing to each other have shifted positions, or more specifically, such that the second jointing projection 7 located on one side surface corresponds to the jointing recess 8 located on the other side surface, and such that the side surfaces adjacent to each other take the same positions.

Figure 4:
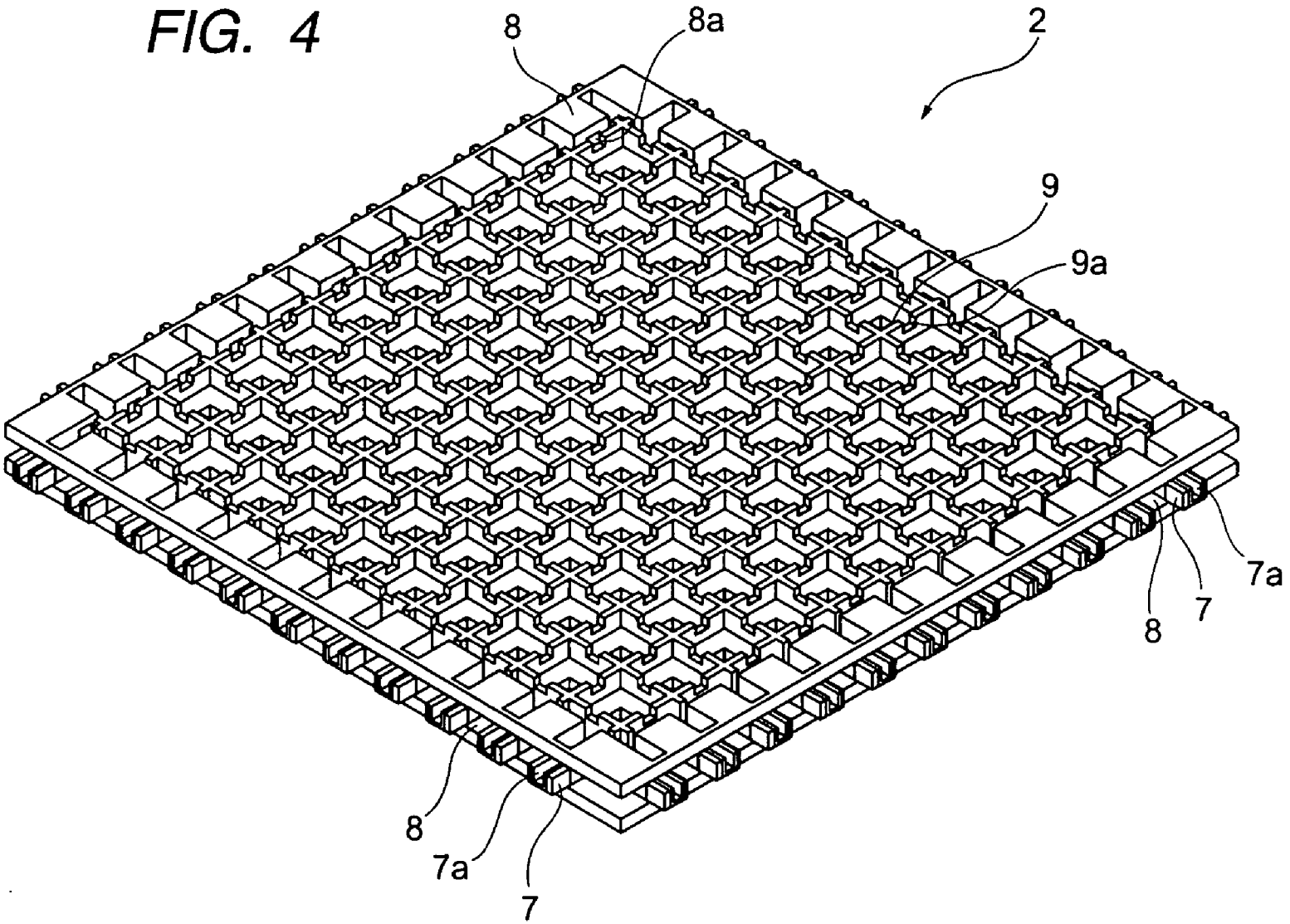
FIG. 4 is a perspective view when viewed from a rear side of the floor foundation block.

The floor foundation block 2 is as shown in FIG. 4 formed to be recessed almost overall rear of the opposite major surface, and a space created by the recess is divided into plural spaces by grid-shaped partition walls 9. The partition walls 9 dividing the recessed space on the other major surface of the floor foundation block 2 are formed with cutouts 9*a* in communication between the spaces divided and located adjacent to each other.

The floor foundation block 2 thus structured is jointed to other element blocks on the one major surface side by fitting the first jointing projection 6 to the jointing recess of other element blocks.

The floor foundation block 2 is jointed to other floor foundation blocks 2 on the side surface thereof by fitting the second jointing projection 7 to the jointing recess 8 of another floor foundation block 2 and fitting the jointing recess 8 to the second jointing projection 7 of another floor foundation block 2. With the floor foundation block 2 at that time, the positions of the projections and the recesses of the side surfaces serving as a jointing surface when the two floor foundation blocks are combined, are always staggered because the second jointing projections 7 and the jointing recesses 8 are provided according to the positional relationship described above. The toy house assembly 1 therefore allows the plural floor foundation blocks 2 to be combined so that the positions of the floor foundation blocks 2 jointly form a single plane without shifting of the position of the side surfaces of the floor foundation blocks 2 adjacent to each other, with no recognition about the orientation of the floor foundation block 2. Alternatively, with this toy house assembly 1, the plural floor foundation blocks 2 can be combined freely in shifting the jointing positions upon minding a real land shape or the like without placing the side surfaces of the floor foundation blocks 2 adjacent to each other at the same plane.

Figure 5A:
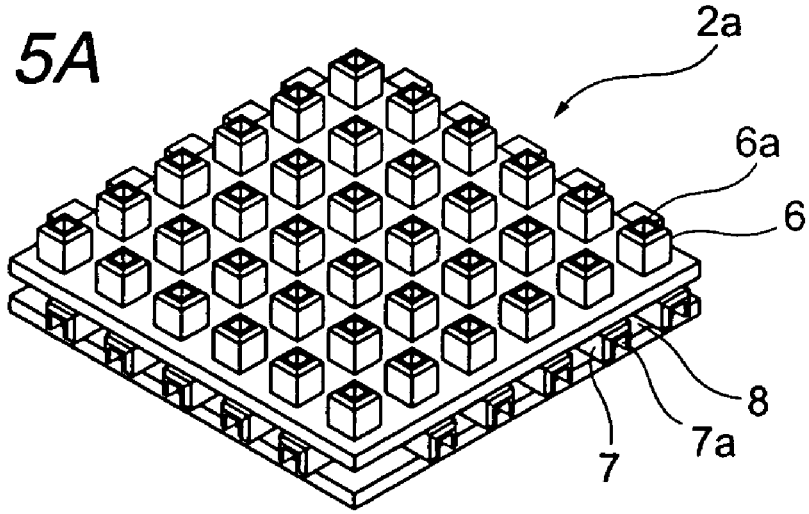
FIG. 5A is a perspective view showing a floor foundation block formed in another shape.
Figure 5B:
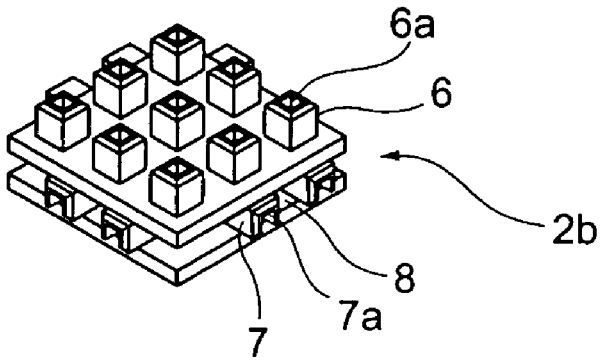
FIG. 5B is a perspective view showing a floor foundation block formed in yet another shape.
Figure 5C:
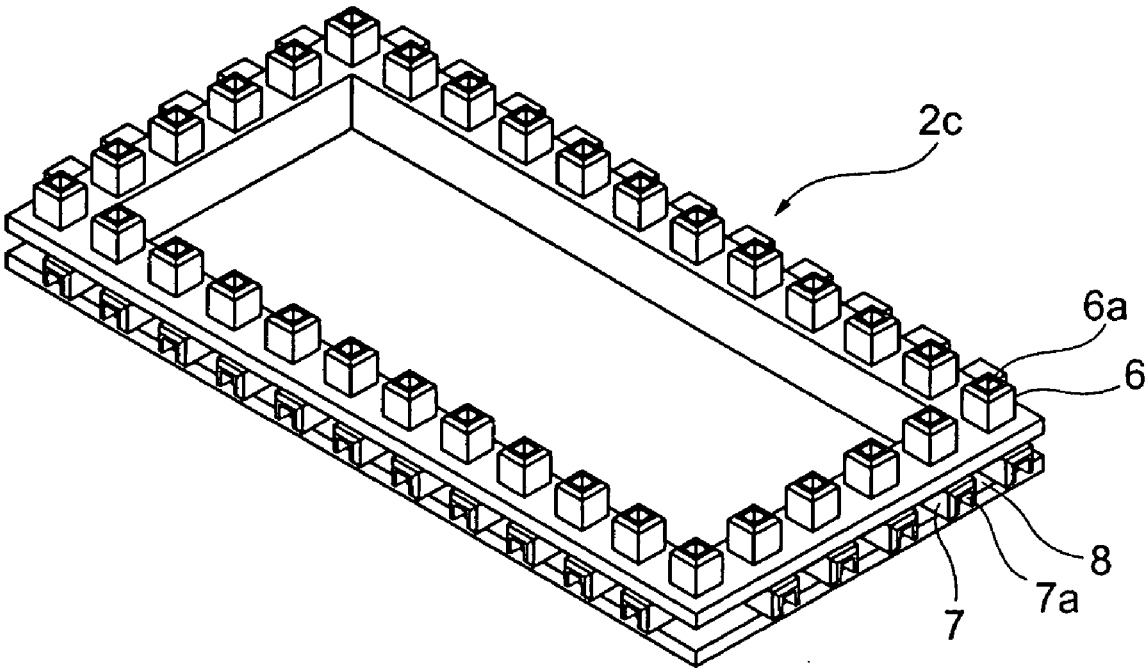
FIG. 5C is a perspective view showing a floor foundation block formed in further another shape.

The floor foundation block 2 is not limited to a block in a square plate shape formed with first jointing projections 6 arranged twelve pieces in the row direction and twelve pieces in the column direction as shown in FIGS. 2, 4, but can be designed to have various shapes according to, e.g., the shape and size of the toy house assembly 1 as far as having respective recesses and projections for jointing as described above. For example, a floor foundation block 2*a* of the one-fourth size of the floor foundation block 2, as shown in FIG. 5A, a floor foundation block 2*b* of the one-sixteenth size of the floor foundation block 2, as shown in FIG. 5B, or a floor foundation block 2*c* of the half size of the floor foundation block 2 formed in a rectangular shape having a window, as shown in FIG. 5C can be made, and floor foundations in various sizes can be manufactured in combination of those blocks. Particularly, the floor foundation block 2*c* is desirably used for two-story toy house assembly in a case that a second floor portion requiring an entrance of the stair is installed. With the floor foundation blocks in the respective sizes described above, where the floor foundation block 2, for instance, can be defined as tubo, one Japanese unit area having 3.3 square meters, and where other blocks having other sizes can be referred to as having, e.g., four Japanese unit area or two Japanese unit area, the house model can be built in recognition of the size of the actual area.

Figure 6:
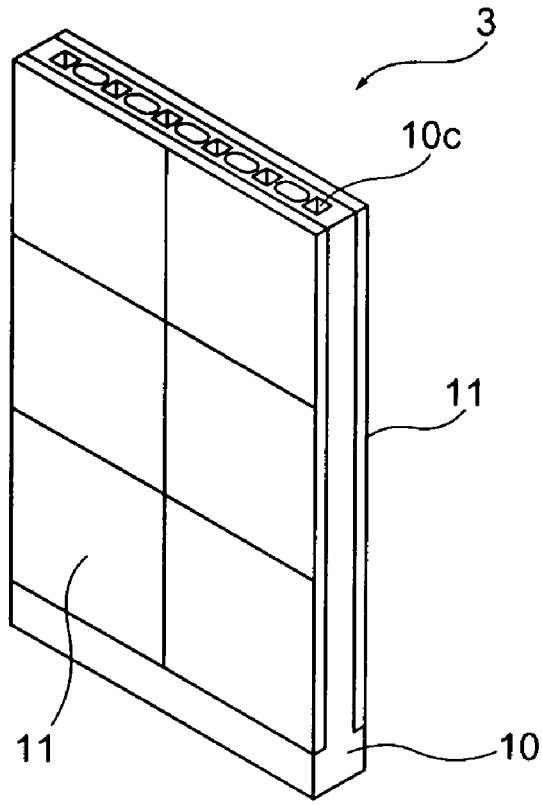
FIG. 6 is a perspective view showing a wall block.
Figure 8:
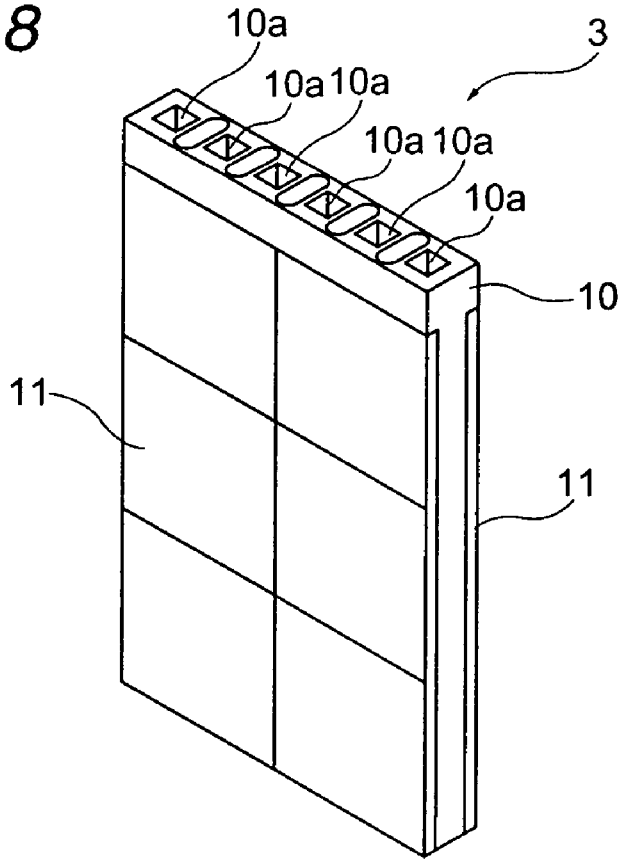
FIG. 8 is a perspective view showing the wall block when viewed from a lower side.
Figure 7:
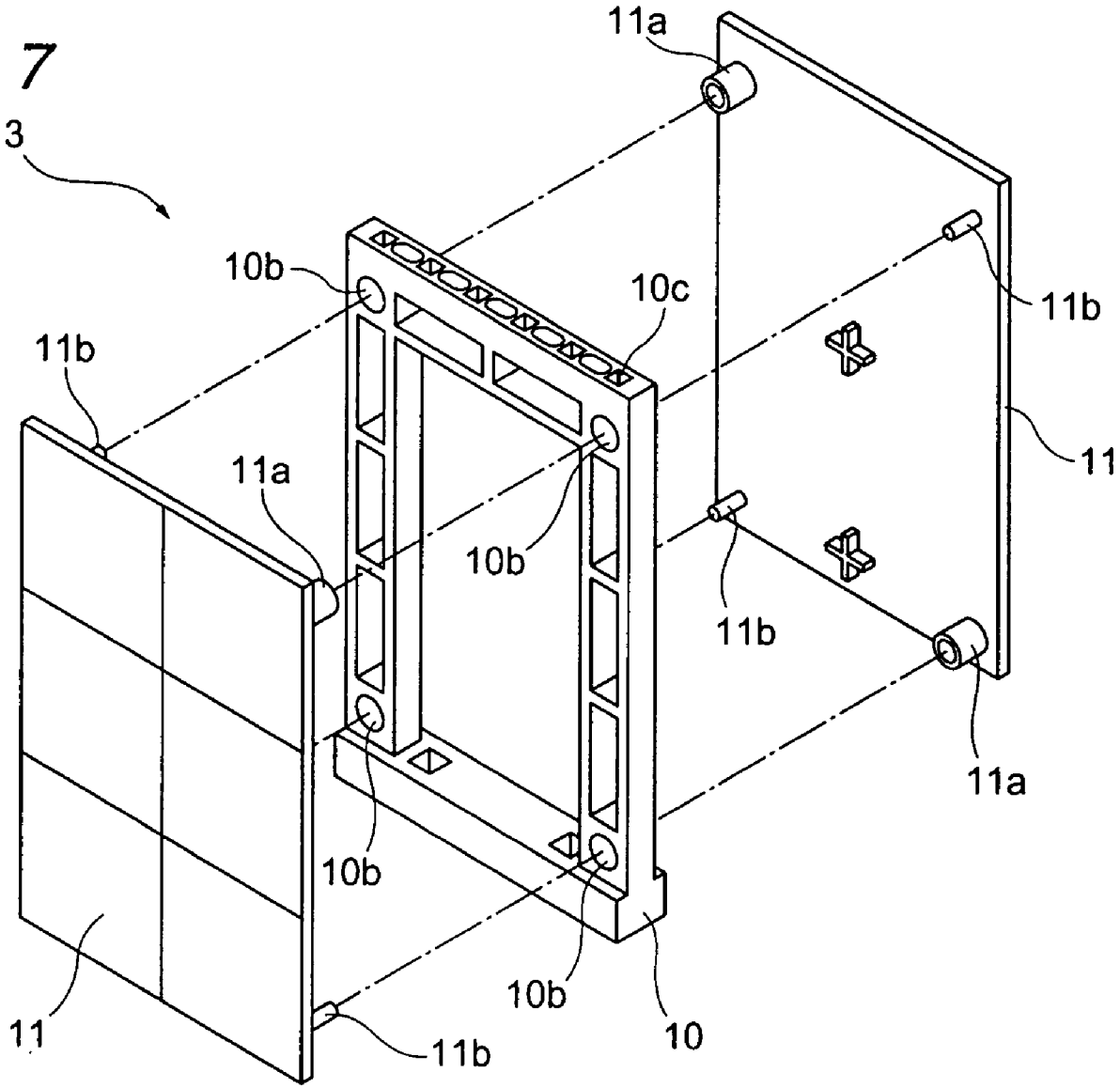
FIG. 7 is an exploded perspective view showing a wall block.

The wall block 3 is constituted, as shown in FIG. 6 and FIG. 7, of a wall foundation 10 and wall panels 10 attached to clamp the wall foundation 10. The wall foundation 10 is formed in a rectangular shape with a rectangular hole opening at a center thereof, and a lower portion of the foundation becomes a jointing portion jointing to the first jointing projection 6 of the floor foundation block 2. As shown in FIG. 8, a first jointing recess 10*a* into which the first jointing projection 6 fits is formed on a lower side of the jointing portion. The first jointing recess 10*a* is provided in a plural number with a uniform interval so that the jointing portion located on the lower side and all of the first jointing projections 6 arranged correspondingly to the jointing portion can be fit when combining the floor foundation block 2. At least one of the plural jointing recesses 10*a*, for example, two jointing recesses 10*a* in this embodiment, are formed as a hole or holes penetrating through the lower side of the foundation 10 as shown in FIG. 7. The wall foundation 10 is formed with a panel attachment hole 10*b* for attaching the wall panel 11 at the corner of the portion built on the jointing portion.

The wall panel 11 is furnished with processing of colors and patterns simulating various wall materials (hereinafter referred to as "wall ornamental pattern"), e.g., marble or brisk, on the one major surface as shown in FIG. 7, and bosses 11*a* and pins 11*b* are formed for attaching to the wall foundation 10 on the other major surface. Those bosses 11*a* and pins 11*b* are provided in a positional relationship such that the boss 11*a* of the one wall panel 11 and the pin 11*b* of the other wall panel 11 are faced at the four corners of the wall panel 11 to each other when the other major surfaces of the wall panel pair 11 are faced to each other.

The wall panel 11 can bring various ornaments on the toy house model when using different patterns between the interior and the exterior of the toy house, and can make a toy house model with increased reality by rendering the interior and exterior closer to the real house having different surfaces between the interior and the exterior.

Figure 9A:
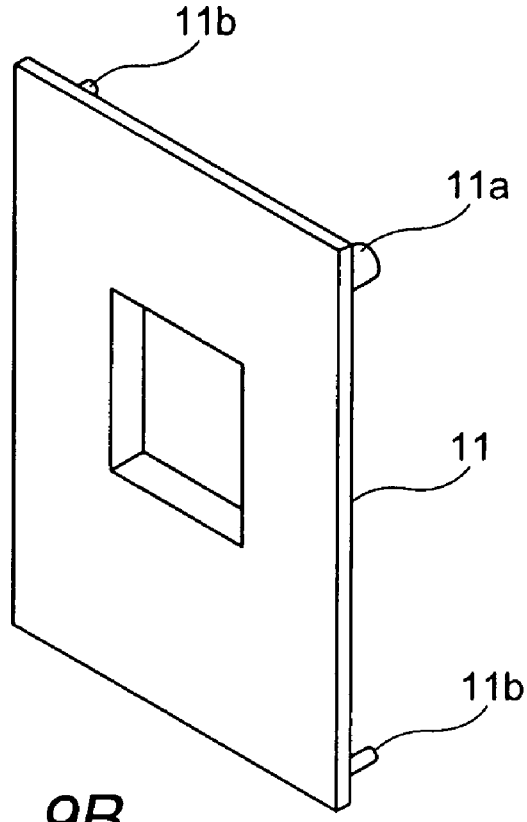
FIG. 9A is a perspective view showing a wall panel having a window pattern.
Figure 9B:
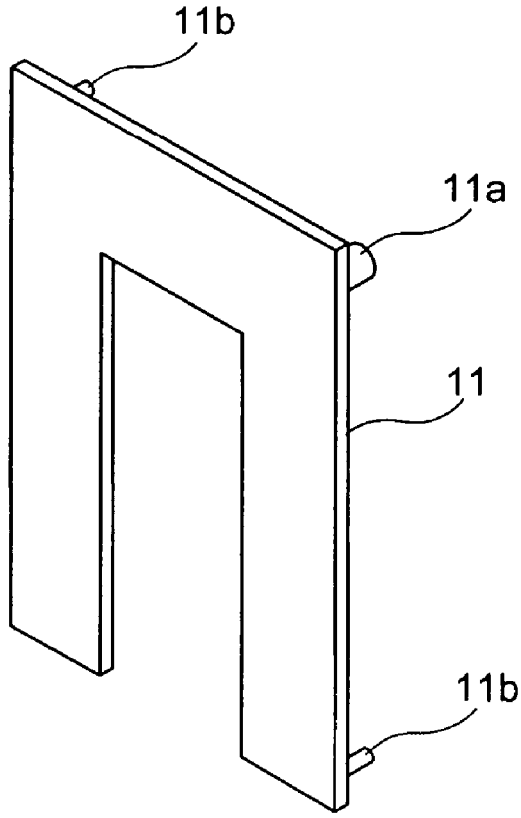
FIG. 9B is a perspective view showing a wall panel having a door pattern.

This wall panel 11 is not only processed with simulations to the materials and states of the wall as described above but also able to be formed in having various shapes as, e.g., a wall having a window pattern by forming an opening at the substantially center thereof as shown in FIG. 9A or a wall having a door pattern by forming a large cutout extending near the center as shown in FIG. 9B. In a case where a wall block 3 having a window pattern or a door pattern as described above is used, the wall panel 11 having the respective shapes described above for both of the inside and the outside of the house.

With the wall block 3 thus structured, as shown in FIG. 7, the pair of the wall panels 11 is attached to the wall foundation 10 by facing the wall panel pair 11 as to clamp the opening portion of the wall foundation 10 and as to cover the opening portion and by fitting the pin 11*b* to the boss 11*a* in the panel attaching holes 10*b* of the wall foundation 10.

The wall block 3 described above is jointed to the floor foundation block 2 by fitting the first jointing projection 6 of the floor foundation block 2 to the first jointing recess 10*a* of the wall foundation 10. The wall of the toy house assembly 1 can be made by jointing the plural wall blocks 3 on the floor foundation block 2 with no interval.

It is to be noted that the wall block 3 is not limited to one having a size shown in FIG. 6, or more specifically, to one having a width of six first jointing recesses 10*a*, but can be formed at various width positions in use of the wall foundation 10 having various widths, for example, a width equal to the two first jointing recesses or the twelve first jointing recesses, as well as the wall panels 11 corresponding to the wall foundation 10. Such a toy house model can be built in consideration of the widths of some real houses upon defining the width of the wall block 3 as a certain unit for a prescribed width, e.g., feet, like the floor foundation block 2 described above. For example, if a necessary width of 8.8 meters to install one of the first jointing recess is defined as one foot, the wall block 3 shown in FIG. 6 is a wall having a width of six feet, and other wall blocks have widths of two feet or twelve feet according to the number of the first jointing recesses.

Figure 10:
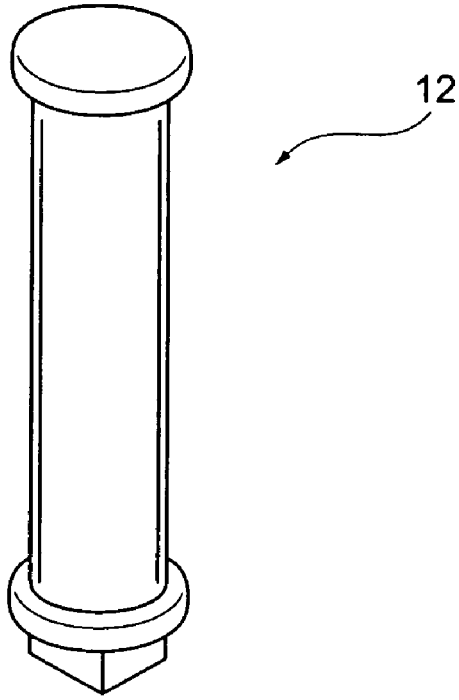
FIG. 10 is a perspective view showing a pillar block.

A pillar block 12 shown in FIG. 10 may be, for example, combined to the floor foundation block 2 so as to be located between the wall blocks 3 to serve as a pillar for rendering the toy house model come closer to the real house. Though any detailed illustration is omitted, the pillar block 12 is formed with one jointing recess at the lower portion similarly to the wall black 3.

Figure 11:
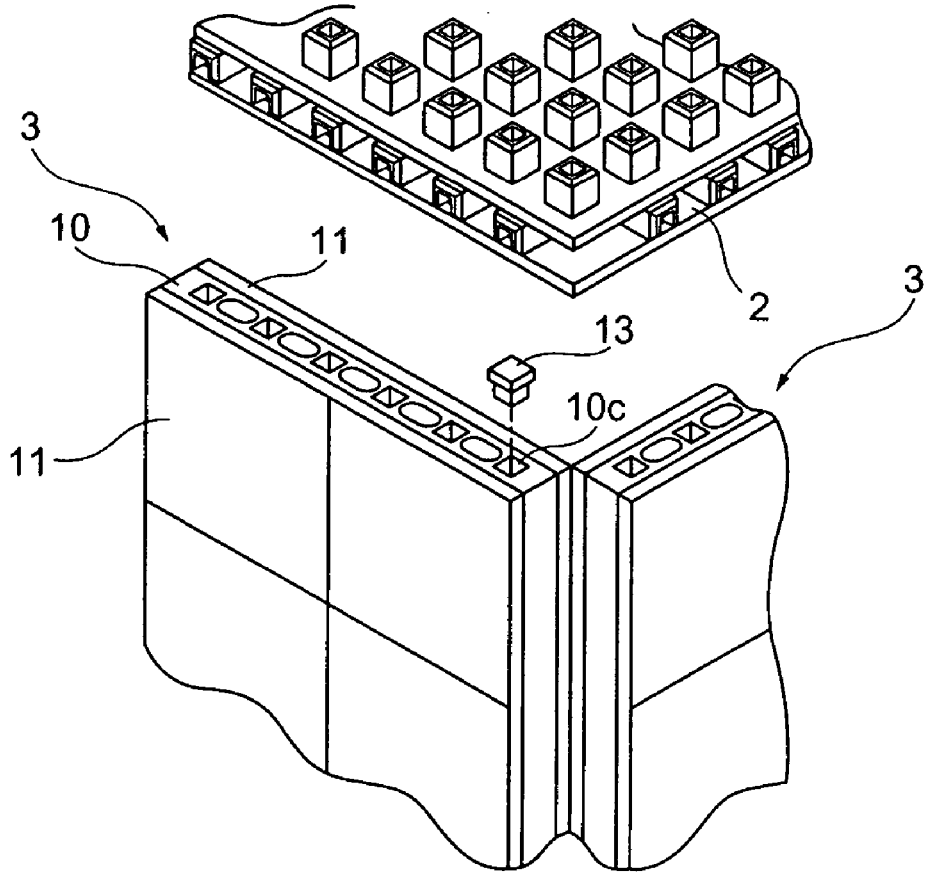
FIG. 11 is an exploded perspective view illustrating a jointing state between the wall block and the floor foundation block.

With the toy house assembly 1, when a two-story toy house model is made as shown in FIG. 1, the floor foundation blocks 2 constituting the floor portion of the second floor are jointed to the wall blocks 3 constituting the wall portion of the first floor. The floor foundation blocks 2 for the floor portion of the second floor and the wall blocks 3 for the wall portion of the first floor are combined by fixtures 13 as shown in FIG. 11. The fixture 13 is a member in a rectangular pillar shape having two different diameters as shown in FIG. 11, is located between the floor foundation block 2 for the floor portion of the second floor and the wall block 3, and is made jointed to the floor foundation block 2 and the wall block 3 by fitting the larger diameter portion into the partition 9 of the floor foundation block 2 and fitting the smaller diameter portion into the second jointing recess 10*c* formed on an upper side of the wall foundation 10 constituting the wall block 3. It is to be noted that the fixture 13 is not limited to having the shape described above and can be in a shape corresponding to the jointing recess or the like formed at the floor foundation block 2 and the wall block 3.

Figure 12:
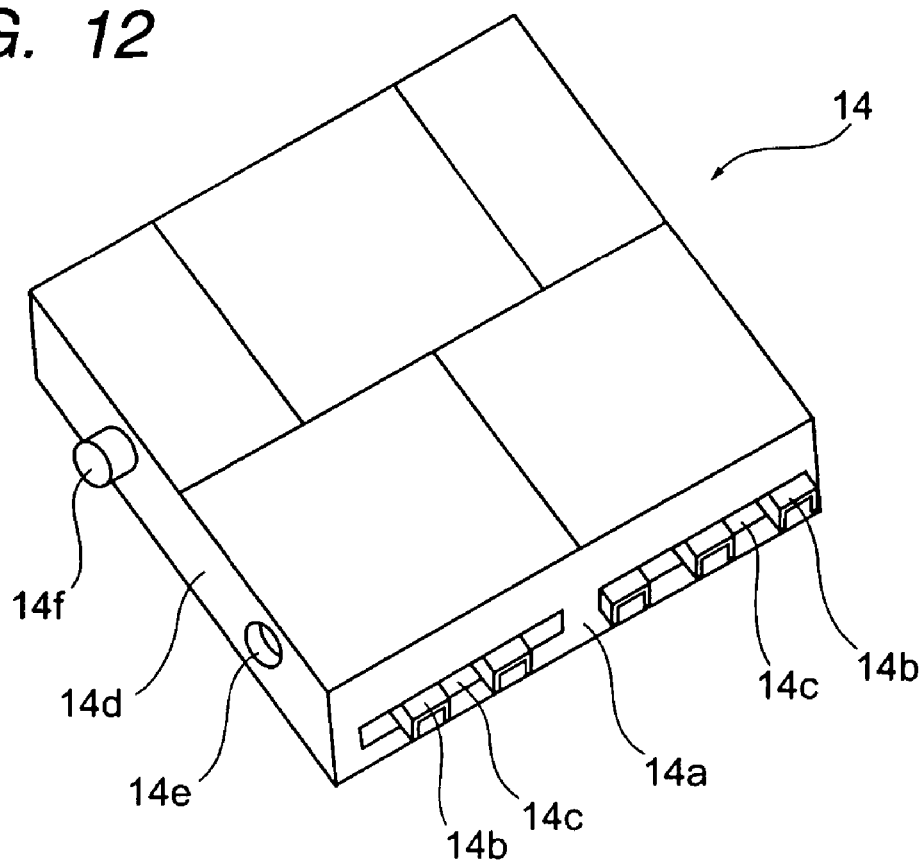
FIG. 12 is a perspective view showing a first structural block of a roof block.

The roof block 4 forms roofs in various shapes by jointing the plural blocks having different shapes. In this embodiment, as shown in FIG. 1, the toy house assembly 1 is described as having a gabled roof made of two inclined surfaces. With the roof blocks 4, an inclined surface portion of the roof in a desired size is formed by vertically and horizontally jointing plural first structural blocks 14 shown in FIG. 12. The first structural blocks 14 are furnished with processing for simulating an actual roof surface on one major surface side of the blocks (hereinafter referred to as a surface of the first structural block 14 on the one major surface side). The patterns of the surface are formed as in continuation with the patterns of the surface of other first structural blocks 14 jointed lengthwise and crosswise.

The first structural block 14 is jointed in a plural number vertically and horizontally to form an inclined surface in a desired size of the roof block 4 as described above, but the jointing surface 14*a* extending perpendicular to an inclined vertical direction directing from the ridge portion of the roof to the roof end portion of the roof is formed in an inclined manner. The inclination of the jointing surface 14*a* has the same direction and angle to the opposite jointing surface 14*a* so that the shape of the jointing surface 14*d* extending perpendicularly to the horizontal direction extending perpendicularly to the inclined vertical direction becomes a parallelogram. Jointing projections 14*b* and jointing recesses 14*c* are formed on the jointing surface 14*a*, and the jointing projections 14*b* and jointing recesses 14*c* are placed alternatively, or more specifically, three projections 14*b* and recesses 14*c* located between the projections 14*b*, and three recesses 14*c* and the projections 14*b* among the three recesses 14*c* are formed on one side and the other side, respectively, with respect to a center of the jointing surface 14*a*. The projections 14*b* and the recesses 14*c* are positionally interchanged at the opposite jointing surface 14*a*, or more specifically, the three recesses 14*c* and the projections 14*b* among these three recesses 14*c*, and the three projections 14*b* and the recesses 14*c* among these projections 14*b* are formed at the opposite positions on one side and on the other side, respectively. Those projections 14*b* and recesses 14*c* are formed to have a prescribed angle, e.g., 35 degrees with respect to a horizontal surface parallel to the surface of the first structural block 14.

The projection 14*b* of the first structural block 14 has a shape cross-sectionally extending in a rectangular letter U-shape having a groove in substantially the same way as that of the second jointing projection 7 of the floor foundation block 2 as described above, and the recess 14*c* is, as shown in FIG. 13, formed with a hole opening on the other major surface side of the first structural block 14 at the rearmost position in substantially the same way as the jointing recess 8 of the floor foundation block 2.

The first structural block 14 has a jointing surface 14*d* extending perpendicularly to the lateral direction and extending vertically as different from the jointing surface 14*a*, and is formed in a parallelogram shape as described above. A jointing projection 14*e* and a hole 14*f* are formed on one surface of the jointing surfaces 14*d*. The jointing projection 14*e* and the hole 14*f* are formed with the interchanged positions at the jointing surface 14*a* facing to one another.

Figure 13:
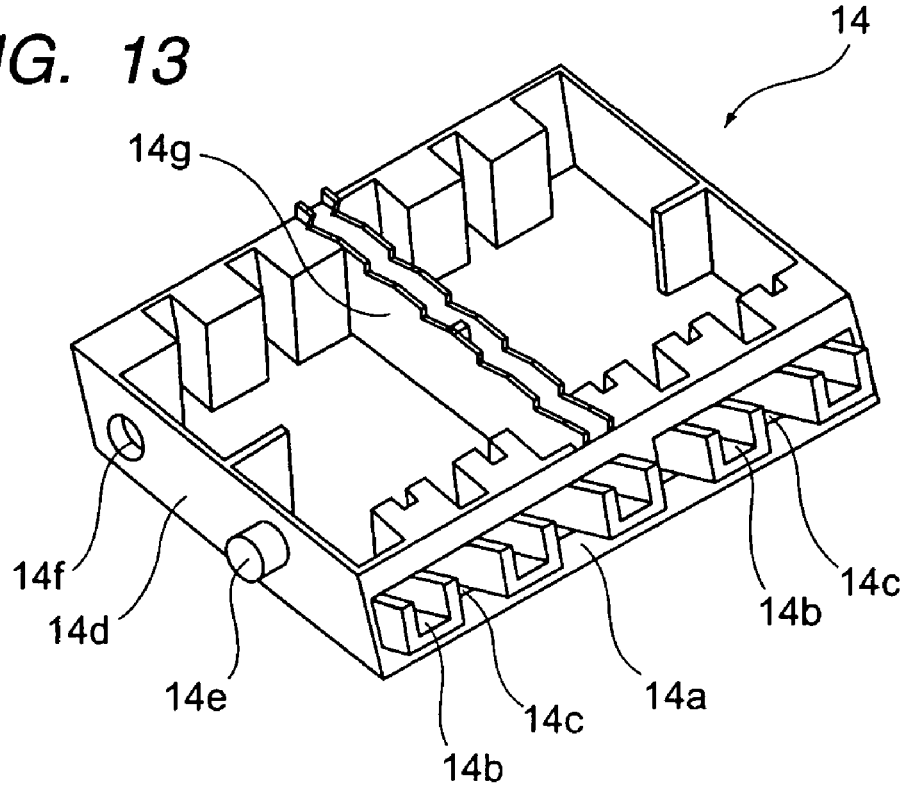
FIG. 13 is a perspective view showing the first structural block when viewed from a rear side.

The first structural block 14 has an upright wall 14*g* having an undulation in a stair shape on the back side of the block as shown in FIG. 13. The upright wall 14*g* is formed along a center axis extending a longitudinal direction of the first structural block 14.

With the roof block 4, jointing for forming a plane and jointing for forming a ridge of the gabled roof can be made by selection as to how the first structural blocks are jointed to the adjacent first structural block when the first structural blocks 14 described above are combined vertically. More specifically, with the plural first structural blocks 14, a plane is formed where the jointing surfaces 14*a* facing to each other are jointed as placed in parallel, and a ridge portion is formed where the jointing surfaces 14*a* are jointed as not parallel and coming the portions of the surface side closer. In the toy house model thus structured, the plane portion and the ridge portion can be made according to the orientation of the jointed structural blocks, so that no special part is required to change the angle when a pair of plane portions astride the ridge portion is built. Therefore, with the toy house assembly 1, fewer blocks are adequate for building the toy house, and the house model can be built more easily.

A portion constituting the roof block 4 and supporting the inclined surface portions of the gabled roof made of the first structural blocks 14 (hereinafter referred to as supporting portion for the roof block 4) is described next. This supporting portion is formed by jointing plural second structural blocks 15 having different shapes shown in FIG. 14. The second structural blocks 15 are made of a substantially triangular apex portion 15*a* placed closest to the ridge portion, a plurality of slope portions 15*b* whose side surface contacts with the inclined surface portion, a rectangular portion or portions 15*c* extending in a rectangular shape to fill the gap between the slope portions 15*b* as placed between the slope portion pair 15*b*, and the supporting portion formed in a triangular shape is structured by jointing the jointing projections and recesses formed at the respective portions. With those second structural blocks 15, the apex portion 15*a* has only recesses on a lower end in FIG. 14; the slope portion 15*b* has projections on an upper end in FIG. 14 except the inclined surface portion and recesses on a lower end; the rectangular portion 15*c* has projections on an upper end in FIG. 14 and recesses on a lower end. Those projections and recesses are formed on the same axis at each portion, and a through hole is made at the projection in penetrating up to the recess.

Figure 14:
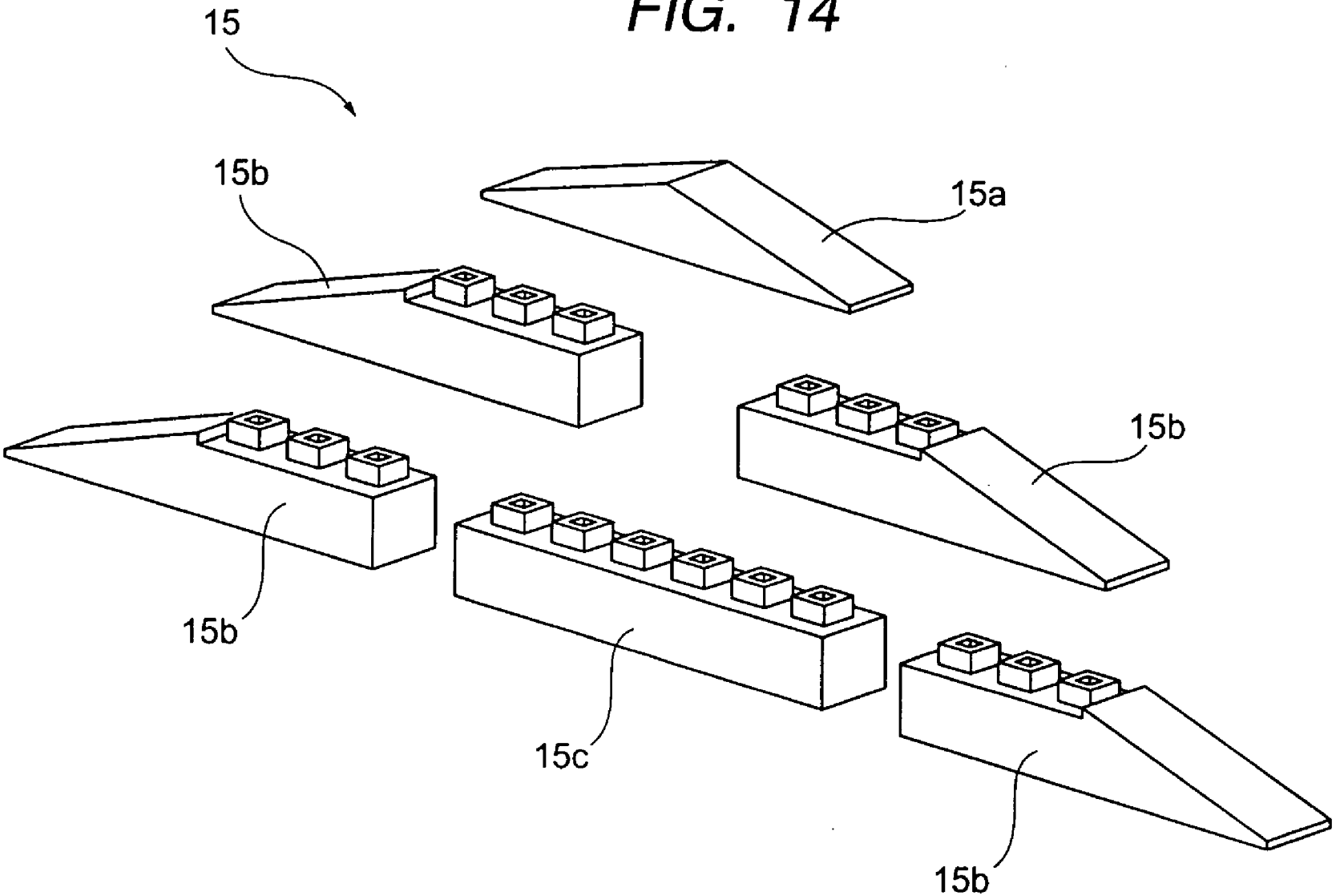
FIG. 14 is an exploded perspective view showing a supporting portion made of a second structural block of a roof block.

The second structural blocks 15 thus described are formed by jointing blocks in a way of providing, in a case of forming the supporting portion of three stages as shown in FIG. 14, the apex portion 15*a* at the first stage closest to the ridge portion, the two slope portions 15*b* at the second stage right below the apex portion so as to form an inclined surface continuous to the slope of the apex portion 15*a*, the two slope portions 15*b* at the third stage as to form an inclined surface continuous to the slope of the slope portions 15*b* placed at the second stage, and the rectangular portion 15*c* between the two slope portions 15*b*.

The roof block 4 is installed on the floor foundation blocks 2 jointed to the wall blocks 3 serving as the wall portions of the second floor by the fixtures 13. More specifically, the roof block 4 is built by mounting the inclined surface portions on the supporting portions jointed on the floor foundation blocks 2 by fitting the first jointing projections 6 to the recesses of the second structural blocks located at the lowest stage. At that time, the undulation of the upright wall 14*g* of the first structural block 14 forming the inclined surface comes in contact with the jointing projection 6 of the floor foundation block 2 and engages with the projections, so that the roof blocks 4 can be installed stably on the floor foundation block 2, and so that the inclined surface portion is prevented from positional shifting.

Figure 15A:
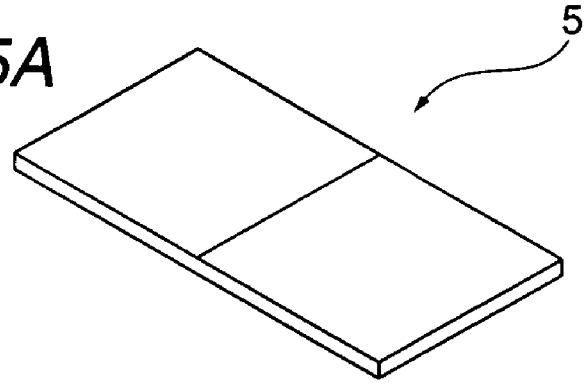
FIG. 15A is a perspective view showing a floor panel.
Figure 15B:
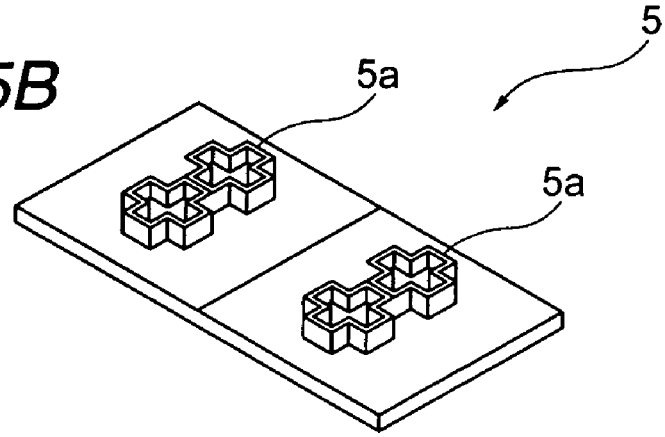
FIG. 15B is a perspective view showing the floor panel when viewed from a rear side.

The floor panel 5 is attached to the floor foundation block 2 located inside the wall blocks 3 on the floor foundation blocks 2. The floor panel 5 is furnished as shown in FIG. 15 on one major surface side of the rectangular thin plate with processing of floor patterns like an actual house, for example such as colors and patterns simulating flooring, tatami, marble, carpet or the like (hereinafter referred to as floor ornamental patterns), and is formed with jointing portions 5 for the floor foundation blocks 2 on the other major surface as shown in FIG. 15B. The jointing portion 5*a* is structured with an upright wall simulating a cross shape as to meet the gap shape among the plural first jointing projections 6 as shown in, e.g., FIG. 15B. The jointing portion 5*a* of the cross shaped upright wall is formed in a plural number to make secure the joint of the floor panel 5 to the floor foundation block 2, and in this embodiment, one set that two pieces are placed adjacently, four pieces in total, is formed.

The floor panel 5 thus structured is mounted on the floor foundation blocks 2 by fitting the jointing portion 5*a* to the gap among the first jointing projections 6. The floor panel 5 can be attached freely by attaching different floor ornamental patterns at respective rooms in accordance with favorite feeling, and can be detached and attached easily at any time, so that people can freely enjoy various floor patterns and changes of those patterns with the toy house model.

It is to be noted that the floor panel 5 is not only of the floor ornamental patterns inside the house as described above but also of processed panels having ornamental patterns such as land surfaces around the house, for example, land surface of lawn, pebbles, concrete, etc., which are provided at the outside of the house. Those various ornamental patterns, including the floor ornamental patterns, are realized by methods such as embossing or illustrating patterns to the floor panel 5, or pasting other members such as stickers of miniatured tatami, carpet, lawn, etc.

The floor panels 5 can be prepared in having various sizes, and the toy house model can be built by considering the room sizes of the real house upon defining the sizes of the panels likewise the floor foundation block 2 as described above. For example, the floor panels 5 having the size shown in FIG. 15A and FIG. 15B, covers over the first jointing projections 6 of three pieces in row and six pieces in column, each of which is defined as one-eighth of the floor foundation block 2 defined as having four tubo (4×3.3. square meters) in the example described above, but this size is set as one Japanese tatami area, and the sizes of six Japanese tatami areas, a half Japanese tatami area, an one-third Japanese tatami area, and two-ninth Japanese tatami area are to be prepared as to meet the various sizes of the rooms in using the one Japanese tatami area as the reference.

The toy house assembly 1 structuring the toy house model with the respective element blocks described above is built by jointing the respective element blocks with the jointing projections and recesses formed at the respective element blocks. No special tool for assembling, such as scissors or paste is needed, and the toy house assembly 1 can be assembled and dissembled easily and can be built again and again repetitively because assembled only by fitting the projections into the recesses, the holes, and the gaps among projections and because the respective element blocks are easily attached and detached.

Figure 16:
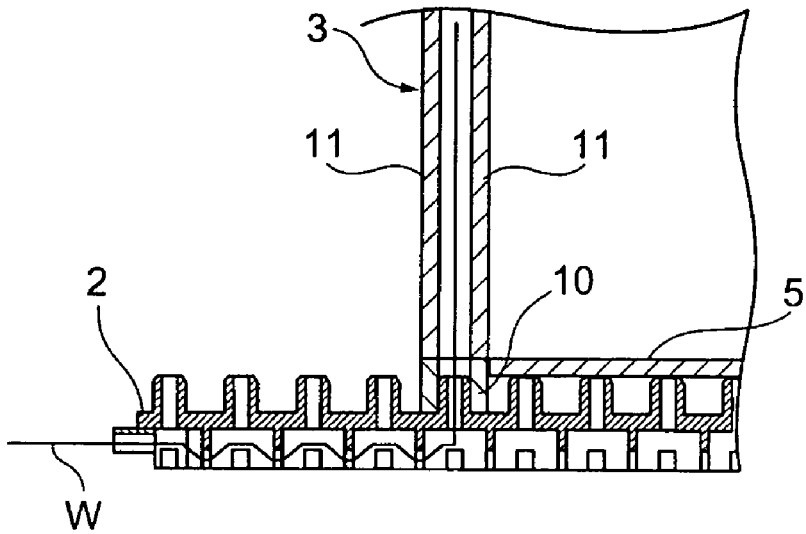
FIG. 16 is a vertical cross section illustrating a wiring state of wires in the toy house assembly.

The toy house assembly 1 can build the toy house model by freely assembling the element blocks having prescribed sizes, thereby making itself excellent in assembling flexibility and extensibility.

Where the toy house model is finished upon assembling the respective element blocks, the toy house assembly 1 allows wirings of wire materials from the outside to the inside of the house model, for example, wiring of wire W for power supply. More specifically, in the toy house assembly 1, the through hole 6 formed at the first jointing projection 6 is in communication with the first jointing recess 10*a* formed as a hole at the jointing portion between the floor foundation block 2 and the wall block 3. The groove 7*a* of the second jointing projection 7 and the hole 8*a* of the jointing recess 8 are in communication with one another at the jointing portion mutually between the floor foundation blocks 2. As shown in FIG. 16, where a wiring for illumination is made from the exterior of the toy house model, the wire W is inserted from the side surface of the floor foundation blocks 2, penetrated through the cutout 9*a* of the partition wall 9, and extended along the wall block 3 upon passing the wire W through the through hole 6*a* of the first jointing projection 6 serving as the contact point to the wall block 3, to supply the power to the illumination such as lights inside the house. Even where the floor foundation blocks 2 are plural, the wires can be provided because the groove 7*a* of the second jointing projection 7 and the hole 8*a* of the jointing recess 8 are in communication with one another. Thus, with the toy house assembly 1, the wires W for, e.g., power supply can be provided easily and freely in utilizing the plural holes formed at the projections and recesses constituting the jointing portions of the respective element blocks in advance. With this wiring, a realistic toy house model can be brought in which illumination is provided inside.

In the toy house assembly 1, the wires can be provided at the jointing portions between the floor foundation block 2 and the roof block 4 and at the jointing portions between the roof block 4 and the respective element blocks, because the holes are formed as to communicate through the jointing portions likewise in the floor foundation block 2 and the wall block 3 or between the floor foundation blocks 2. The toy house assembly 1 can make wiring with wires W freely all over the house and render the flexibility of illumination installment.

Because of excellent flexibility and extensibility in assembling work, the toy house assembly 1 can be used as not only a play tool for, e.g., kid's housekeeping play but also an intelligent developing toy, and also can be advantageous as an ornament for appreciation, a tool for planning layout changes of real rooms or reformation, and an image model when the real house is built.

Figure 17:
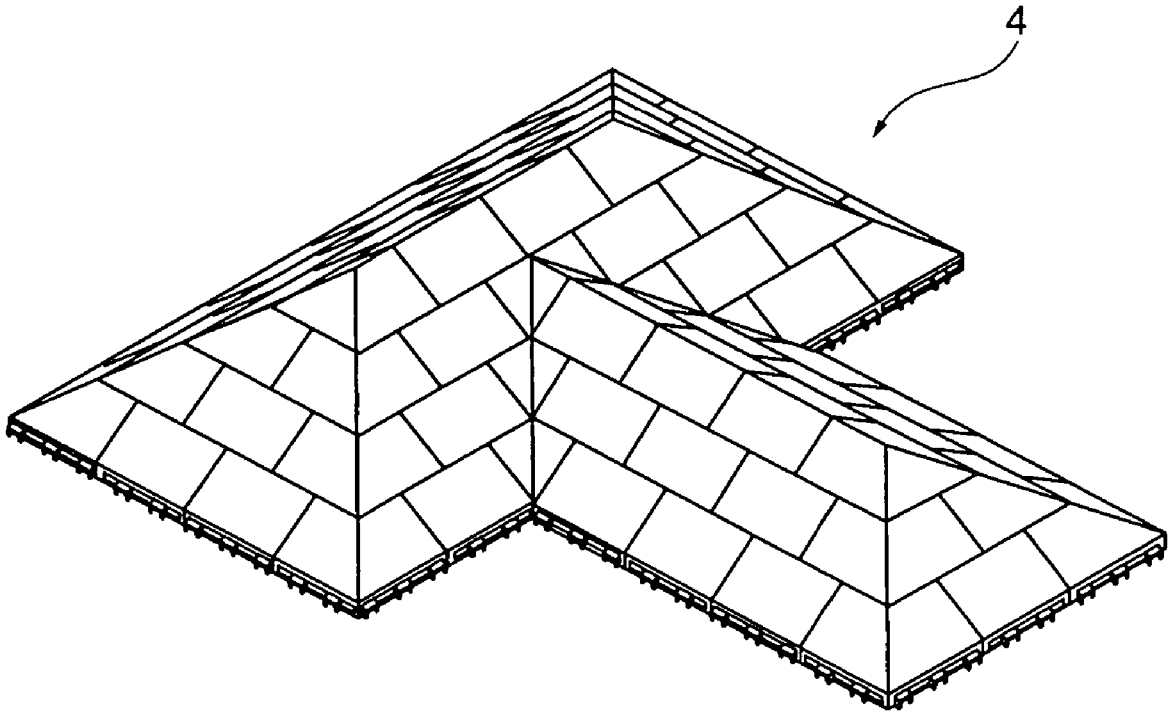
FIG. 17 is a perspective view showing another shape of a roof block.
Figure 19:
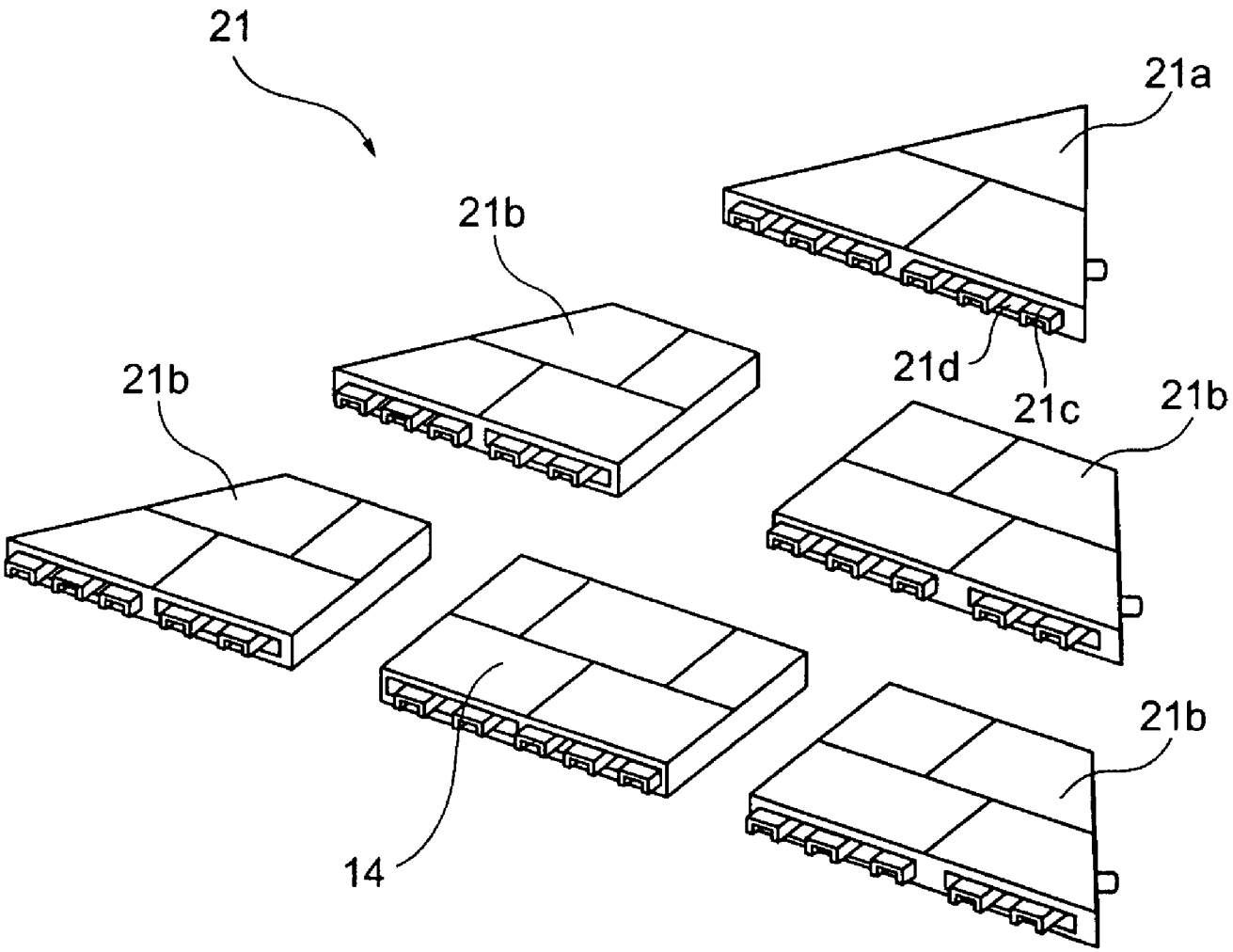
FIG. 19 is an exploded view showing an inclined surface made of a third structural block of a roof block.

It is to be noted that the toy house assembly 1 is not limited to the structure described above and can be modified properly as far as not loosing the major subject matters. In the embodiment described above, the roof is in a gabled shaped roof, but can be in other shapes, e.g., in a hipped shape roof having the slopes direction four direction as shown in FIG. 17 or a pyramidal shape roof as shown in FIG. 18.

Where the hipped roof is made as shown in FIG. 17, a third structural block 21 structuring jointing portions of inclined surfaces adjacent to those of the first structural blocks 14, or namely a narrower side section, other than the ridge portion as shown in FIG. 19 in addition to the first structural blocks described above. The third structural blocks 21 are made of an apex portion 21*a* disposed closest to the ridge portion, and side section portions 21*b* constituting the narrow side section located on a lower side (or a roof edge side) of the apex portion 21*a*, and a sloped ridge, or a hip portion, as the jointing portion between the inclined surface in substantially a triangle shape formed by combing and jointing those portions in a plural number and the inclined surface made of the first structural blocks 14 adjacent to the inclined surface, is formed by combining those blocks in a plural number. The apex portion 21*a* has a substantially equilateral triangle shape as shown in FIG. 17, and has projections 21*c* and holes 21*d* in substantially the same way as the jointing surface 14*a* of the first structural blocks 14 on one side surface and projections 21*e* and holes 21*f* in substantially the same way as the jointing surface 14*d* on the other side surface. The side section 21*b* is in a substantially trapezoid shape, and has projections 21*g* and holes 21*h* in substantially the same way as the jointing surface 14*a* of the first structural blocks 14 on side surfaces at an upper edge and a lower edge and projections 21*i* and holes 21*j* in substantially the same way as the jointing surface 14*d* on the sloped side surface. There are two types of the side section portions 21*b:* as shown in FIG. 19, the side surfaces formed with inclined side surfaces formed with projections 21*i* and holes 21*j* in a way opposite to each other.

With the third structural block 21, the slope side surface of the respective portions is formed in an inclined manner toward the inner side. Therefore, the side section portion is formed upon jointing with an angle where the respective side surfaces described above are made as the jointing surfaces.

Figure 18:
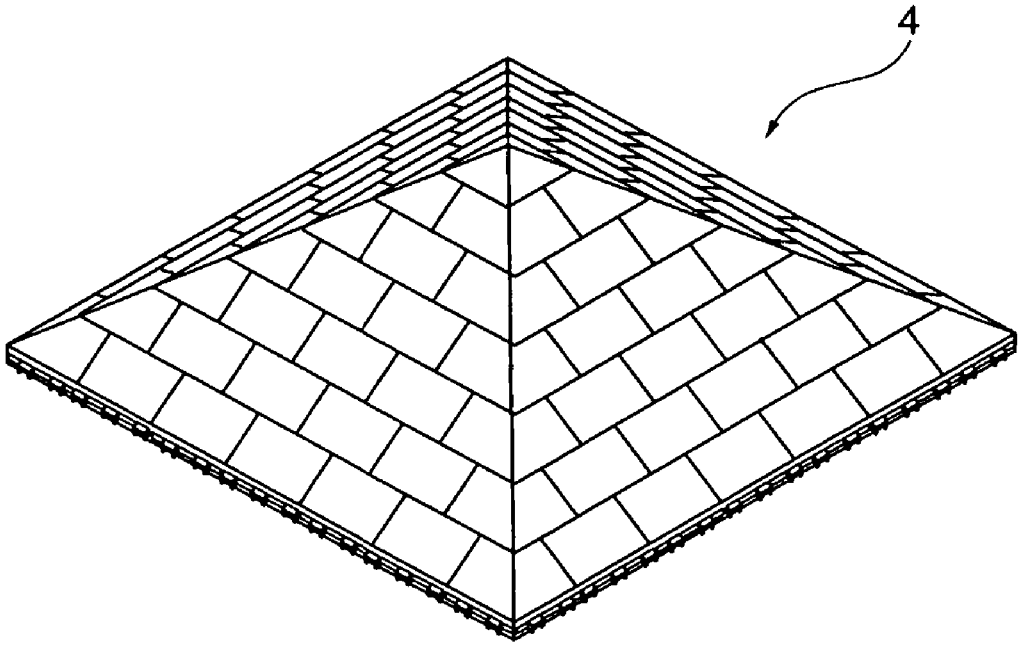
FIG. 18 is a perspective view showing yet another shape of a roof block.

To form the pyramidal roof as shown in FIG. 18, the first structural blocks 14 and the third structural blocks 21 as described above form the inclined surfaces extending in a substantially triangle shape, thereby jointing the inclined surfaces in the substantially triangle shape for four surfaces.

INDUSTRIAL APPLICABILITY

As described above in detail, the toy house assembly according to the invention allows easy and flexible wiring of wires for such as power supply in utilizing holes provided at the jointing portion of the respective blocks, so that a further real house model can be built by placing illumination or the like inside the house model.

According to this invention, both of a plane and a bending portion can be formed by changing the jointing orientation of the structural blocks of one type, so that no special part is needed for a portion changing the roof angle such as the ridge portion, and so that the number of parts can be reduced. Therefore, with this invention, assembling work can be simplified by a fewer number of parts.

What is claimed is:

1. A toy house assembly for building a toy house model by assembling a plurality of blocks different in shape, comprising:

a floor foundation block serving as a foundation of the toy house model to constitute a floor portion of the toy house model, including a first projection formed on a major surface of the floor foundation block to be combined with another block of a type different from the floor foundation block, and including a second projection and a second recess formed on a side surface that is oriented perpendicular to the major surfaces, to be combined with another block of the same type as the floor foundation block;

a wall block constituting a wall portion of the toy house model and including a first recess fitting to the first projection of the floor foundation block; and a roof block constituting a roof portion of the toy house model, the roof block being made of a plurality of structural block groups combined vertically and horizontally;

wherein a hole for connecting the blocks combined by connection between at least one respective projection and the corresponding recess is formed at each jointing portion between the respective blocks, and wherein a wiring is provided through the hole from an exterior of the toy house model to an interior of the toy house model.

2. The toy house assembly according to claim 1, wherein the roof block includes a structural block made in a substantially rectangular shape having a pair of side surfaces inclined in the same direction with the same angle to each other, and wherein the structural block forms a plane upon jointing another structural block where the side surfaces formed in parallel are jointed and forms a bending portion upon jointing another structural block where the side surfaces formed not in parallel are jointed.

3. The toy house assembly according to claim 1, wherein the wall block is made of a wall foundation formed in a rectangular shape having a rectangular opening at a center thereof, and a pair of wall panels so attached as to sandwich and to cover up the rectangular opening.

4. The toy house assembly according to claim 1, and further comprising a floor panel mounted on the major surface of the floor foundation block, the floor panel having a major surface formed with a floor decorative pattern and the opposite major surface formed with a jointing portion for jointing the floor foundation block.

5. The toy house assembly according to claim 1, comprising holes between the at least one respective projection and the corresponding recess, further comprising aligned holes in a mating projection and recess.

* * * * *